US007833088B1

(12) United States Patent
Studer

(10) Patent No.: US 7,833,088 B1
(45) Date of Patent: Nov. 16, 2010

(54) CONSTRUCTION METHOD AND TOOL SUPPORTING SAID METHOD

(76) Inventor: Ronald M. Studer, 1820 E. Mansfield St., Bucyrus, OH (US) 44820

( * ) Notice: Subject to any disclaimer, the term of this patent is extended or adjusted under 35 U.S.C. 154(b) by 0 days.

(21) Appl. No.: 11/837,103

(22) Filed: Aug. 10, 2007

Related U.S. Application Data

(60) Provisional application No. 60/822,092, filed on Aug. 11, 2006.

(51) Int. Cl.
*B24B 7/22* (2006.01)

(52) U.S. Cl. ..... 451/41; 125/15

(58) Field of Classification Search ..... 451/41, 451/541, 548, 353, 359; 125/15, 25
See application file for complete search history.

(56) References Cited

U.S. PATENT DOCUMENTS 3,145,511 A 8/1964 Bird et al.
4,962,742 A 10/1990 Nishizawa et al.
5,316,416 A 5/1994 Kim
5,323,670 A * 6/1994 Dietz ..... 76/112
5,331,769 A 7/1994 Walton
5,392,759 A 2/1995 Kwang
5,468,176 A 11/1995 Udert et al.
5,605,493 A * 2/1997 Donatelli et al. ..... 451/41
5,911,620 A 6/1999 Spangenberg et al.
6,129,077 A * 10/2000 Parini ..... 125/15
6,196,911 B1 3/2001 Preston et al.
6,203,416 B1 3/2001 Mizuno et al.
6,280,309 B1 * 8/2001 Van Osenbruggen ..... 451/415
6,299,522 B1 10/2001 Lee
6,371,103 B1 * 4/2002 Lupi ..... 125/40
6,454,632 B1 * 9/2002 Jones et al. ..... 451/28
6,526,959 B1 3/2003 Lee et al.
6,527,633 B1 3/2003 Tank et al.
6,551,181 B2 4/2003 Lee
6,739,963 B1 5/2004 Mas Garcia
6,814,657 B2 11/2004 Spangenberg et al.
6,827,074 B2 * 12/2004 Gardner ..... 125/25
6,878,051 B2 4/2005 Brach
6,890,250 B1 5/2005 Kim et al.
7,000,606 B2 2/2006 Gardner
2002/0115398 A1 8/2002 Lee et al.
2002/0137444 A1 9/2002 Yoshida et al.
2003/0139128 A1 7/2003 Spangenberg et al.
2004/0137834 A1 7/2004 Webb et al.
2005/0164620 A1 7/2005 Amamoto
2005/0188981 A1 9/2005 Kim et al.
2006/0116060 A1 6/2006 Thysell
2006/0160481 A1 7/2006 Miyanaga

* cited by examiner

*Primary Examiner*—Robert Rose
(74) *Attorney, Agent, or Firm*—Pearne & Gordon LLP

(57) ABSTRACT

A method for improving the appearance of a building, and a tool to support the method, especially where the tool uses a commercially available cutting blade used in a manner other than its intended use.

12 Claims, 7 Drawing Sheets

CONSTRUCTION METHOD AND TOOL SUPPORTING SAID METHOD

CROSS-REFERENCES TO RELATED APPLICATIONS

This application claims the benefit of provisional application Ser. No. 60/822,092 filed on Aug. 11, 2006, incorporated herein by reference.

BACKGROUND OF THE INVENTION

This application relates to a method for improving the appearance of a building, and a tool to support the method.

Restoration of existing buildings is a common task. A method for improving the appearance of such buildings would be useful, as would a tool that supports the method. Furthermore, this method could be utilized for new construction as well, adapting less expensive materials to have the appearance of more expensive materials.

SUMMARY OF THE INVENTION

Provided are a plurality of embodiments the invention, including, but not limited to, a method of using a cutting blade disk manufactured for cutting a hard material via a circumferential edge, said method comprising the steps of:

adapting the cutting blade for use with a tool that rotates the disk while exposing one of the flat radial surfaces of the disk; and using the rotating flat radial surface to remove material from a surface.

Also provided is a method of modifying a surface of a hard material, said method comprising the steps of:

providing a tool for rotating a cutting disk including a diamond or a carbide cutting portion exposed on one of the flat radial surfaces of the disk;

applying said flat radial surface to the surface of the hard material;

removing some portion of the surface of the hard material; and refinishing the surface of the hard material.

Still further provided is a method of refinishing a surface of a wall or a floor of a building, said wall or floor comprising a concrete or ceramic material, said method comprising the steps of:

providing a tool for rotating a cutting disk including a diamond or a carbide cutting portion exposed on one of the flat radial surfaces of the disk;

applying said flat radial surface to the surface;

removing a substantial portion of the surface of the hard material; and refinishing the surface of the hard material.

Also provided are additional embodiments of the invention, some, but not all of which, are described hereinbelow in more detail.

BRIEF DESCRIPTION OF THE DRAWINGS

The features and advantages of the examples of the present invention described herein will become apparent to those skilled in the art to which the present invention relates upon reading the following description, with reference to the accompanying drawings, in which.

DETAILED DESCRIPTION OF THE EXAMPLE EMBODIMENTS

A method for improving the appearance of a building or other structure is provided, with the method being usable at least for restoring existing buildings and improving new buildings. Also provided is a tool in support of this method.

In essence, the method is for refinishing the surface, in particular the outer surface, of a building, especially when that surface is made of a relatively hard substance, such as concrete blocks or stone, brick, and glazed tile for example. The surface can be modified to have the appearance of bricks, for example.

Furthermore, a resurfacing tool is provided for modifying the surface. This tool can utilize four inch and larger circular diamond blades that are readily available at retail stores, and which are economical to purchase. The common and intended function of these blades is typically to cut concrete, brick and tile into various shapes, much like cutting wooden 2×4 s, for example. These blades are typically cutting disks that are manufactured for use in cutting materials using their other circumferential edge, and not by using the flat radial surface of the disk. Accordingly, the cutting material is typically found around the outer circumference of the disk, and the disk is typically for use in a circular-saw type device, where the large radial surfaces are typically not exposed (but are, in fact, usually partially or totally hidden. The method provided herein utilizes these disks in an alternative manner, such that their radial surface is exposed and used for removing material.

This tool can be used, for example, on a commercial brick building for cutting/grinding/reshaping the "surface" of concrete and brick, not simply cut it. This can be done by laying the circular blade flat against the surface, rather than using it at a right angle, as it would typically be used.

The cutting blade, which could include a diamond or carbide cutting material, can be modified by drilling and countersinking a series of holes in a circular pattern around a number of diamond blades. The countersinking permits attaching the blades to an arbor using countersunk/tapered screws that fit flush against the blade when tightened. This prevents the heads of the screws attaching the blade to an arbor from being ground off while the blade is rotating, keeping the blade securely attached to the arbor. This also keeps the heads of the screws from marring the finish of the surface that is being shaped.

Figure 1A:
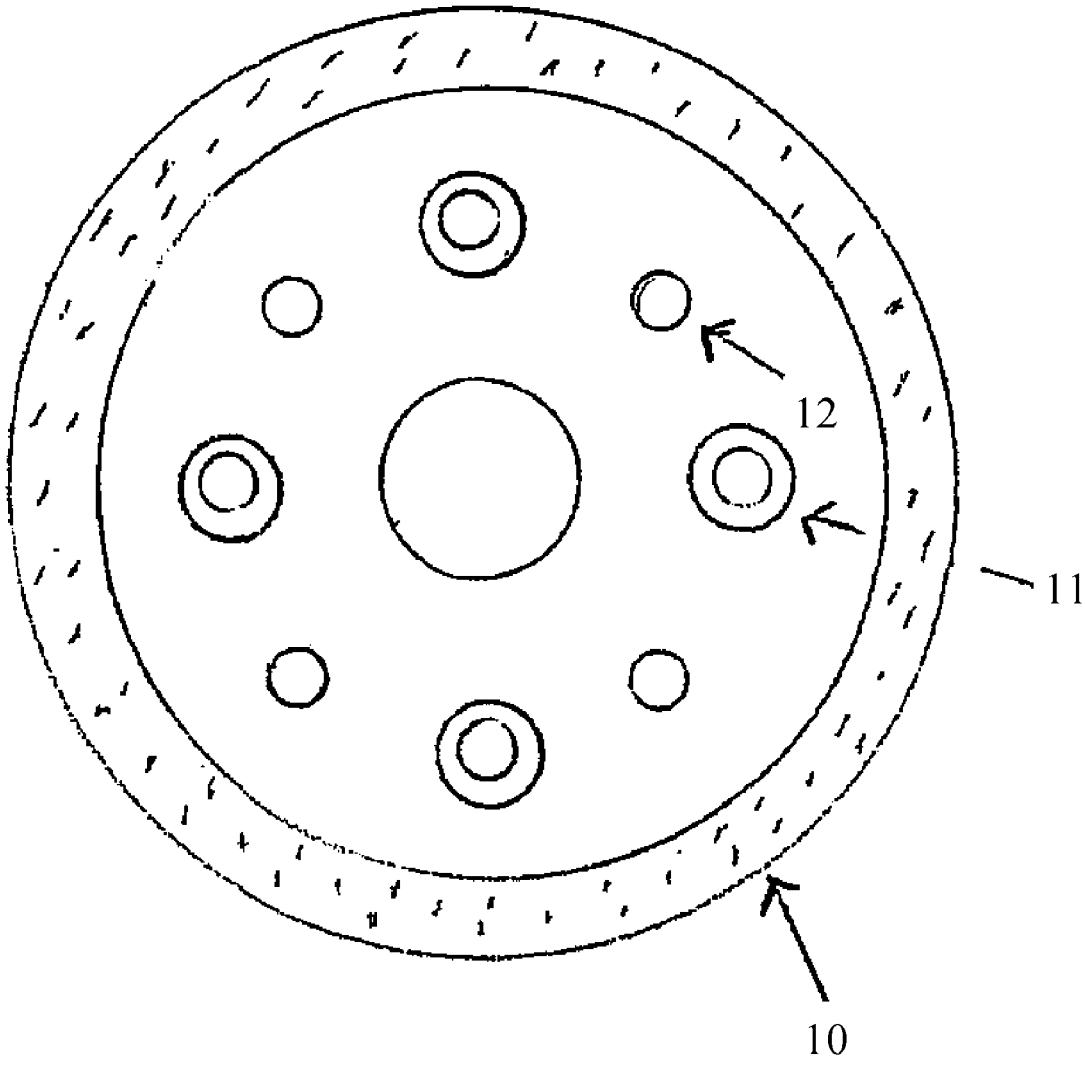
FIG. 1A is a schematic diagram showing a radial surface of a cutting blade disk.
Figure 1B:
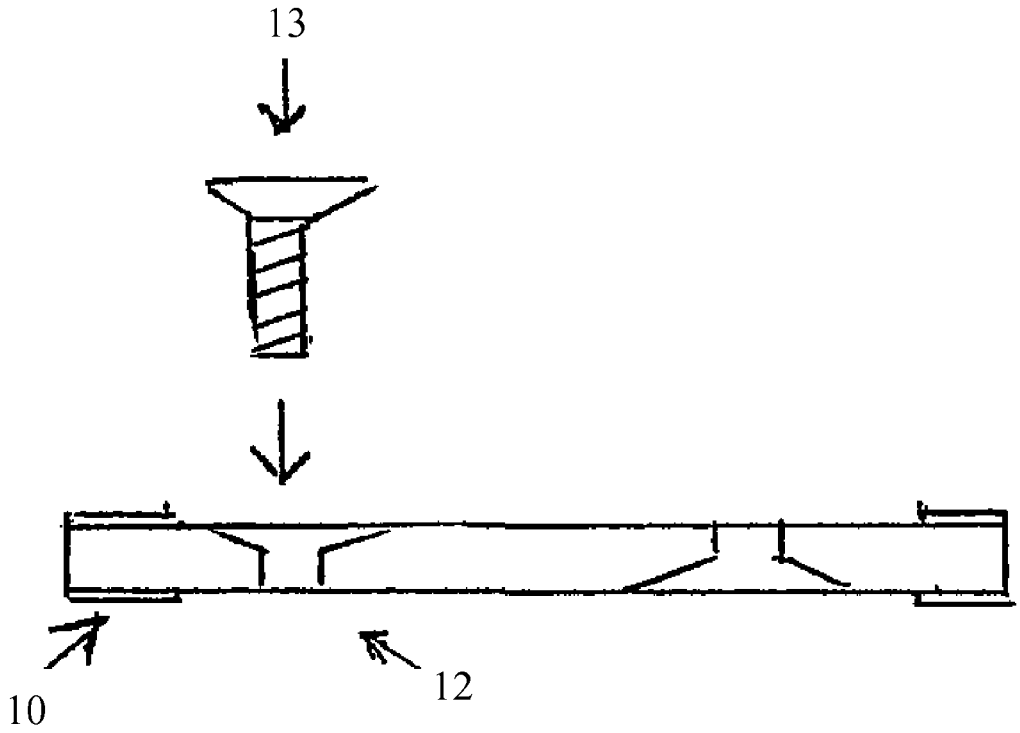
FIG. 1B is a schematic diagram showing the circumferential cutting edge of the cutting blade disk of FIG. 1A.
Figure 2:
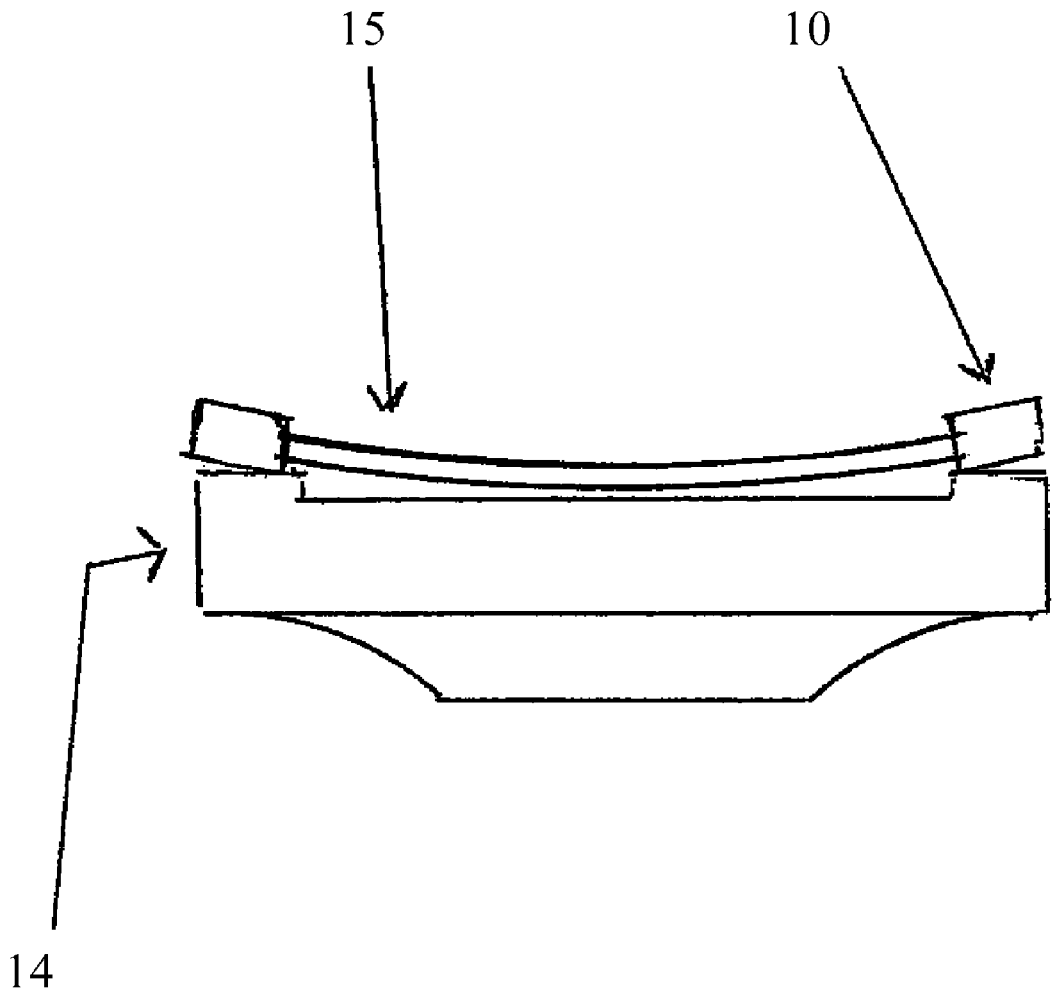
FIG. 2 is a schematic diagram showing a side view of the disk of FIGS. 1A and 1B placed in an arbor.

FIG. 1A shows an example of such a blade. The diamond cutting media 10 that is fused to these circular blades is on one or both sides of the blades. The blade is modified by drilling and countersinking holes 11, 12 on opposite sides of the blade so that when the cutting media was worn off one side of a two-sided blade, the blade could be flipped over to use the second side. FIG. 1B shows how the holes 11, 12 are utilized with a screw 13 to secure the blade.

The arbors that the blades attach to have a threaded hole through their center which allows them to be attached to or detached from hand held grinders, sanders, or other rotary tools/devices. However, these cutting disks are not the flat disks typically used for grinding or sanding surfaces, but are disks typically used for cutting materials into pieces.

Figure 3:
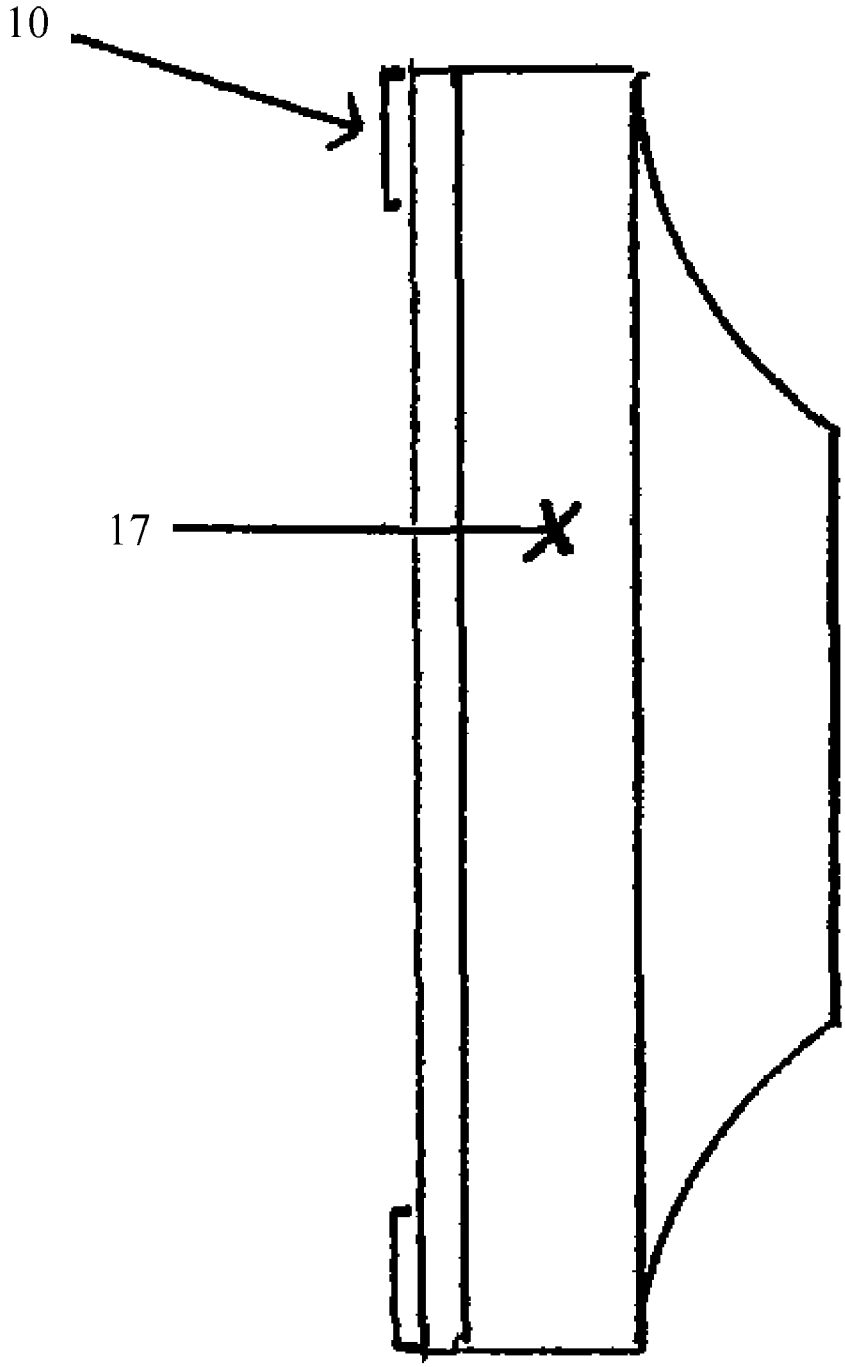
FIG. 3 shows a side view of a disposable unified blade/arbor structure.

A stepped portion near 14 typically found on the surface of the arbor at an outer edge can advantageously cause the blade body to bow or cup slightly, as shown at 15 in FIG. 3, when the countersunk attach screws are tightened. This keeps the blade body from being worn away as the blade is rotated, maintaining the integrity of the blade body, allowing just the diamond media to get worn away.

An edge guard 14 can be provided that is several times the thickness of the diamond blade to prevent major injury to the user in case the user comes into contact with the blade. This edge guarded arbor is substantial in itself because the edge guard safety feature allows for the relatively safe attachment of carbide and other types of circular blades for use on wood or other materials.

The tool is used by applying the rotating blade to the surface that is to be modified. One side of a four inch diamond blade can be used to resurface about 300 square feet of glazed tile, making its surface paintable or otherwise refinishable. This is very economical, as it allows the surface material to be used in a different manner than originally intended.

One side of a four inch blade can also be used to remove the paint from about 300 square feet of concrete. Using chemical paint strippers to do the same thing would require "at least" three gallons of stripper at a substantial additional cost without any substantial increase in labor. In fact, labor can actually be reduced in some cases by a factor of 4. Also, the fumes involved in using chemical strippers can be avoided.

Another embodiment of the tool can use pneumatic air tools as a grinder, with a guard including a collet for attaching the guard to the air tool. A dust shroud with a vacuum attachment, itself attached to the grinder can be used eliminate a lot of the dust that can be made during this process.

When refinishing concrete (painting or concrete overlay) very strong cleaners are typically first be used to clean the surface for proper bonding to the concrete. This tool and method eliminates the need for many of those chemicals because it exposes a fresh, clean surface that allows for proper bonding. This reduces the costs and hazards associated with those chemicals, and delivers a superior surface for refinishing.

This technique, using these diamond blades and tools, can also be used to level missteps in concrete floors, where a crack in a concrete floor results in the concrete on one side of the crack being slightly higher or lower than the concrete on the other side of the crack.

I had to make this tool because I needed it and couldn't find it on the market. It Further embodiments, As shown in FIG. 3, includes a permanently attached blade and arbor pair having an abrasive 10 on one side, eliminating the need for countersinking screws to attach the blade to the arbor. The arbor 17 could be made of a metallic or plastic composition, for example. This example uses a steel blade with abrasive fused to only one side of the blade. The blade is then fused or molded to a plastic or die-cast metal arbor. This is a disposable blade-arbor combination.

This device can be used to set the blade flat or to cup it. Flat is shown in FIG. 3. Modifications to the steel body of the blade to prep it for fusing to the arbor body (e.g. providing many little holes for attachment) are not shown.

Figure 4A:
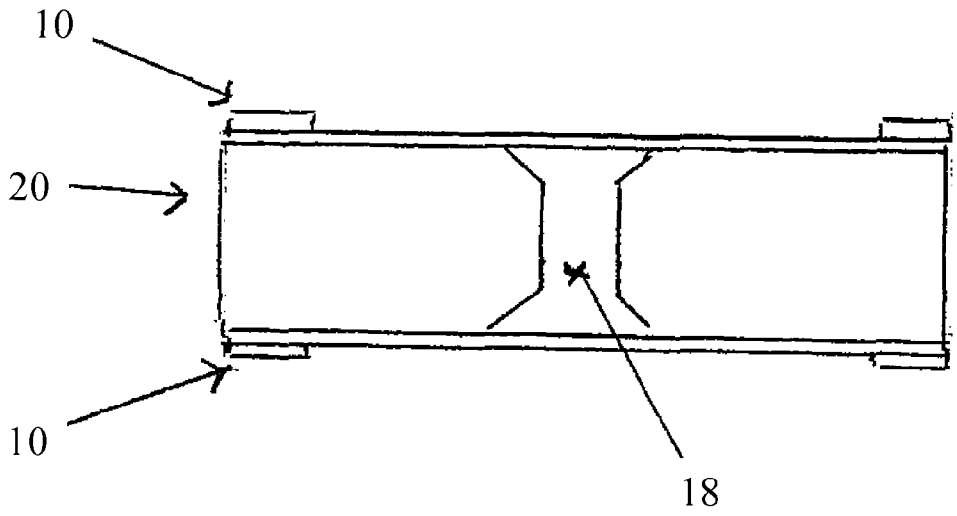
FIGS. 4A and 4B are schematic diagrams of side views two additional embodiments of cutting blades.

FIG. 4A shows an embodiment using two blades with abrasive 10 fused to only one side of the blade, with each blade being fused/molded to the opposite side of a plastic or die-cast metal body 20 with a hole 18 for attachment to the desired rotating tool. This allows you to flip the blade when one side is worn out.

Figure 4B:
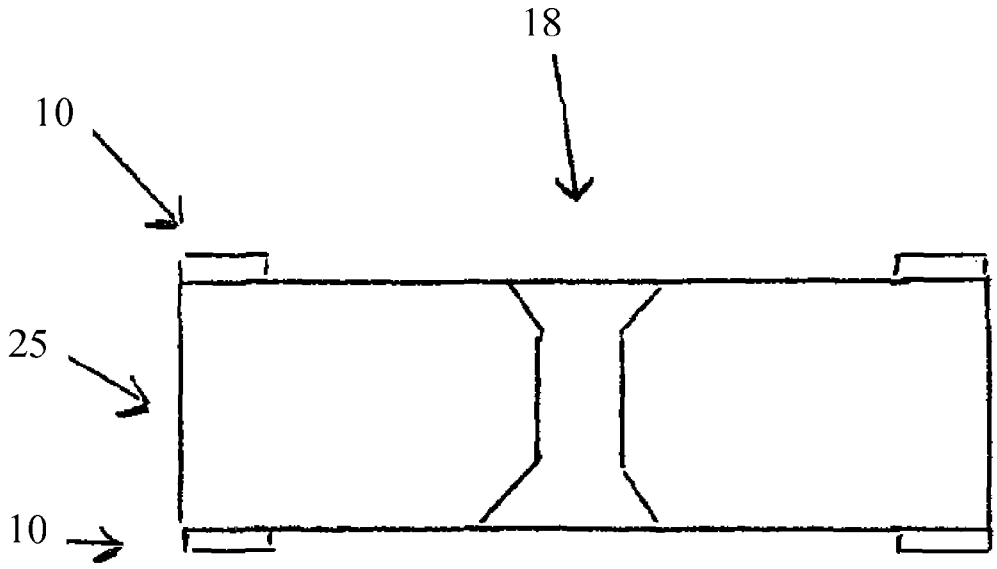

A further embodiment shown in FIG. 4B, fabricated by using an extra-thick steel blade 25 and fusing abrasives to opposite sides of it. This would eliminate the need for the plastic or die-cast metal body 20 shown in FIG. 4A.

Figure 5A:
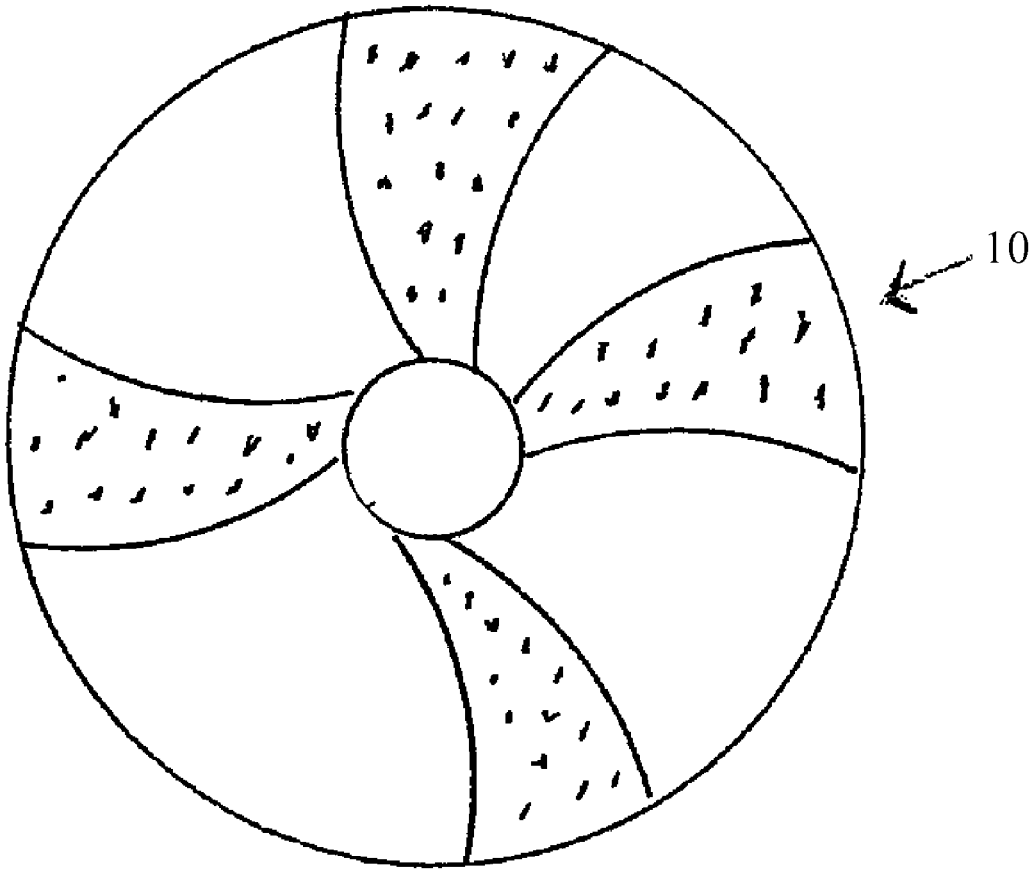
FIGS. 5A and 5B are schematic diagrams of radial surfaces of additional embodiments of cutting blades.
Figure 5B:
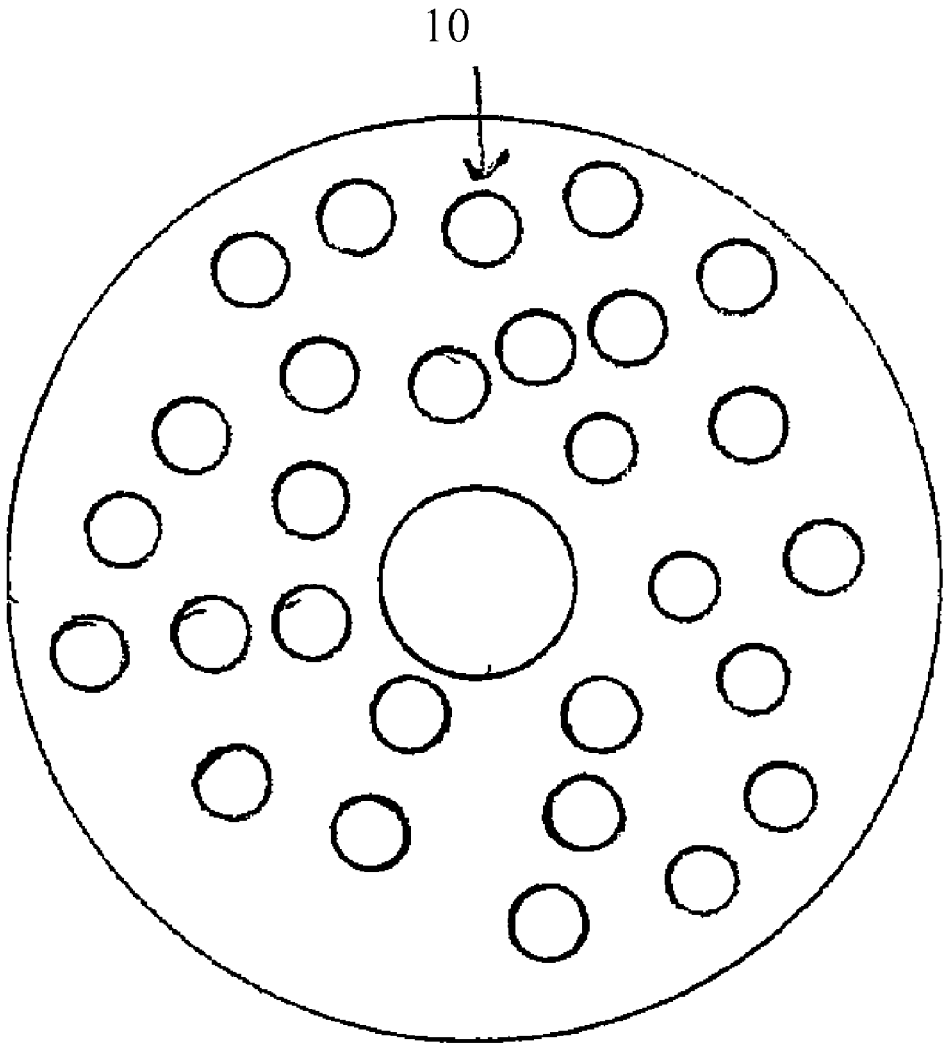

Laying diamond and/or carbide abrasive blades flat allows these types of blades to be used for more applications than they are presently applied to. With that in mind, different abrasive patterns may be designed for different applications, as shown in the examples of FIGS. 5A and 5B.

Accordingly, these various tools can be used to remove existing finishes from hard surfaces, or adapt existing surfaces to different uses, such as adapting a concrete or tile wall or floor to be painted, shaping concrete walls, flattening uneven surfaces, etc. This is accomplished by using one of the above tools, or a similar tool, to adapt a cutting blade (such as typically used in a circular saw) for use as a surface removal device by using the flat edge of the blade being rotated by a motorized tool, rather than the circumferential edge as the blade was intended to be used. Furthermore, as discussed above, blades specifically designed for such uses can be developed.

The invention has been described hereinabove using specific examples and embodiments; however, it will be understood by those skilled in the art that various alternatives may be used and equivalents may be substituted for elements and/or steps described herein, without deviating from the scope of the invention. Modifications may be necessary to adapt the invention to a particular situation or to particular needs without departing from the scope of the invention. It is intended that the invention not be limited to the particular implementations and embodiments described herein, but that the claims be given their broadest interpretation to cover all embodiments, literal or equivalent, disclosed or not, covered thereby.

What is claimed is:

1. A method of using a cutting blade disk manufactured for cutting a hard material via a circumferential edge that extends between opposing radial surfaces of the disk, said method comprising the steps of:

adapting the cutting blade for use with a tool that rotates the disk while exposing one of the radial surfaces of the disk, said adapting including:

placing the other of the radial surfaces of the disk against an arbor having a radial surface with a radius that is about equal to the radius of the cutting blade, such that said arbor contacts an abrasive portion of the surface on the other of the radial surfaces, and attaching the disk to the arbor at a central portion of the arbor so as to force the disk against the arbor causing the disk to cup from the circumferential edge to the center of the disk; and using the rotating radial surface to remove material from a surface.

2. The method of claim 1, wherein said cutting blade has a cutting surface including diamond or a carbide.

3. The method of claim 1, wherein said method further includes the step of refinishing the surface of the hard material.

4. The method of claim 1, wherein said hard material includes cement or ceramic material.

5. The method of claim 1 wherein said hard material is a cement block.

6. The method of claim 1 wherein said hard material is a ceramic tile.

7. The method of claim 1 wherein said hard material is a wall or a floor of a building.

8. A grinding tool, comprising:

a cutting blade disk having a cutting surface on a circumferential edge of the disk that extends between opposing radial surfaces of the disk, and an arbor to which the cutting blade disk is attached, the arbor having a stepped portion that is raised with respect to a central portion of the arbor, wherein the stepped portion, adjacent to the circumferential edge, presses against one of the radial surfaces of the disk, and wherein the disk is attached to the arbor at said central portion so as to cause the disk to cup between the stepped portion and the central portion, due to the attachment of the disk to the arbor with the stepped portion pressing against the surface of the disk adjacent to the circumferential edge, and wherein said arbor covers or is in contact with an abrasive portion of the surface of one of the radial surfaces.

9. The grinding tool of claim 8, wherein the cutting surface on the circumferential edge includes diamond or a carbide.

10. A method of using a grinding tool comprising:

a cutting blade disk having a cutting surface on a circumferential edge of the disk that extends between opposing radial surfaces of the disk, and an arbor to which the cutting blade disk is attached, the arbor having a stepped portion that is raised with respect to a central portion of the arbor, wherein the stepped portion, adjacent to the circumferential edge, presses against one of the radial surfaces of the disk, and wherein the disk is attached to the arbor at said central portion so as to cause the disk to cup between the stepped portion and the central portion, due to the attachment of the disk to the arbor with the stepped portion pressing against the surface of the disk adjacent to the circumferential edge, thereby exposing a concave surface of the disk opposite the arbor for covering an abrasive surface on a convex surface of the disk;

said method comprising the steps of:

applying said concave surface of the disk to the surface of the hard material while said cutting disk is rotated at high speed by the arbor; and removing some portion of the surface of the hard material using the rotating cutting disk.

11. A method of grinding a work surface using a cutting blade disk having first and second radial surfaces and being manufactured for cutting into a hard material via a circumferential edge, said method comprising the steps of:

adapting the cutting blade for use with a tool that rotates the disk while exposing one of the radial surfaces of the disk, said adapting including:

placing the other of the radial surfaces of the disk against an arbor having a radial surface with a radius that is about equal to the radius of the cutting blade, such that said arbor covers an abrasive portion on the first radial surface, and attaching the disk to the arbor at a central portion of the arbor so as to force the disk against the arbor in a manner to expose the second radial surface of the blade but also protect a user from said first radial surface of the blade; and placing the second radial surface of the blade against the work surface to grind away portions of the work surface.

12. The method of claim 11, wherein the step of attaching the disk to the arbor at a central portion of the arbor so as to force the disk against the arbor causes the disk to cup from the circumferential edge to the center of the disk.

* * * * *

UNITED STATES PATENT AND TRADEMARK OFFICE

CERTIFICATE OF CORRECTION

PATENT NO. : 7,833,088 B1
APPLICATION NO. : 11/837103
DATED : November 16, 2010
INVENTOR(S) : Studer It is certified that error appears in the above-identified patent and that said Letters Patent is hereby corrected as shown below:

In column 3, line 51, please delete the second occurance of the word "It" after the word -market.-

Signed and Sealed this
Twenty-fifth Day of January, 2011

David J. Kappos

David J. Kappos
*Director of the United States Patent and Trademark Office*